US006323810B1

(12) United States Patent
Poilasne et al.

(10) Patent No.: US 6,323,810 B1
(45) Date of Patent: Nov. 27, 2001

(54) MULTIMODE GROUNDED FINGER PATCH ANTENNA

(75) Inventors: Gregory Poilasne; Laurent Desclos, both of Los Angeles, CA (US)

(73) Assignee: Ethertronics, Inc., San Diego, CA (US)

( * ) Notice: Subject to any disclaimer, the term of this patent is extended or adjusted under 35 U.S.C. 154(b) by 0 days.

(21) Appl. No.: 09/801,134

(22) Filed: Mar. 6, 2001

(51) Int. Cl.[7] ..... H01Q 1/38
(52) U.S. Cl. ..... 343/700 MS; 343/846
(58) Field of Search ..... 343/700 MS, 702, 343/767, 770, 846, 848, 860, 749, 750, 829

(56) References Cited

U.S. PATENT DOCUMENTS 4,749,996 * 6/1988 Tresselt ..... 343/700 MS
5,410,323 * 4/1995 Kuroda ..... 343/700 MS
6,181,281 * 1/2001 Desclos et al. ..... 343/700 MS
6,211,825 * 4/2001 Deng ..... 343/700 MS

* cited by examiner

*Primary Examiner*—Tan Ho
(74) *Attorney, Agent, or Firm*—Blakely, Sokoloff, Taylor & Zafman LLP

(57) ABSTRACT

A small, printed antenna provides high efficiency, good isolation and a broad working bandwidth. These characteristics are achieved with a patch antenna by placing a shunt to ground connected to the feeding point of the patch. This shunt comprises a line running along one edge of the patch. The patch dimensions can be adjusted, and in particular reduced, by changing the L and C characteristics of the patch. This is accomplished with arrays of slots defining corresponding arrays of fingers along the edges of the patch. Impedance matching is achieved by altering the dimensions of the slots.

33 Claims, 4 Drawing Sheets

MULTIMODE GROUNDED FINGER PATCH ANTENNA

BACKGROUND OF THE INVENTION

1. Field of the Invention

This invention relates to antennas for use with radio transceivers. More particularly, the invention provides a small multiband patch antenna with very high efficiency and high isolation for use in cellular telephones and other personal electronic devices.

2. Background

Cellular telephones and other wireless electronic devices are widely used. Such devices have steadily grown smaller with advances in miniaturization of electronic components. This has created a challenge for the design of antennas in such devices. At the same time, it is desirable for the antenna to have a broad working bandwidth.

Various methods are known in the art to broaden the operating bandwidth of an antenna. Most of these employ parasitic elements that are excited by a driven element. In most cases, the elements are capacitively coupled. In the case of patch elements, the methods often rely on optimization of the coupling between the patches. The modes excited inside the different elements are basically the same.

Different methods exist in order to reduce the dimensions of a patch antenna. One such method is described in *Size Reduction of Patch Antenna by Means of Inductive Slits*, Reed, S., Desclos, L., Terret, C., Toutain, S., APS/URSI 20000 Utah. This method places a set of slits in the patch that represents an inductive loading. The authors report that a reduction of 50% in the dimensions of the patch antenna was achieved with this approach. Generally speaking, however, as the patch gets smaller, the efficiency decreases and the working bandwidth gets smaller.

SUMMARY OF THE INVENTION

The present invention comprises a small, printed antenna with high efficiency, good isolation and a broad working bandwidth. These characteristics are achieved with a patch antenna by placing a shunt to ground connected to the feeding point of the patch. This shunt comprises a line running along one edge of the patch. The patch dimensions can be adjusted, and in particular reduced, by changing the L and C characteristics of the patch. This is accomplished with arrays of slots defining corresponding arrays of fingers along the edges of the patch. Impedance matching is achieved by altering the dimensions of the slots.

By adding a strip line shunt at the feed point of the antenna, an efficient driving element for exciting the antenna is defined. This strip line at the frequency of use constitutes an inductance. While it helps with broadband matching, it also creates a capacitive coupling with the first neighbor finger. From this strong coupling, it is possible to excite different modes. In fact, the shunt helps to unbalance the antenna, which should not be considered as a patch under a classical mode. The antenna can be considered as a set of fingers that will combine in either an array form or single couple of fingers.

The bandwidth of the antenna is increased by adding as many couples of fingers as frequencies needed to form the total bandwidth by the addition of the subside bands.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
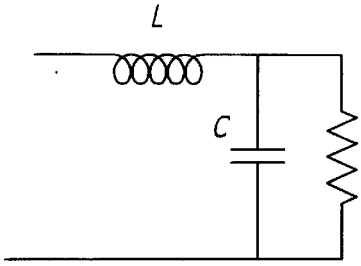
FIG. 1 is an equivalent circuit diagram of a simple patch antenna.

FIG. 1 is an equivalent circuit diagram for a simple patch antenna. The inductance L and capacitance C may be adjusted to control the resonant frequency of the patch. However, adjusting these values are not effective for increasing the bandwidth of the antenna particularly when the physical dimensions of the patch are reduced, nor is it effective for matching the input impedance of the antenna, which, in the most common applications, should be matched to 50 ohms.

Figure 2:
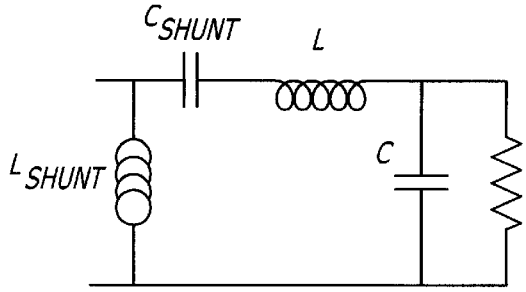
FIG. 2 is an equivalent circuit diagram of a patch antenna with a shunt coupling the feed point to the ground plane.

By introducing an additional inductance at the input to the patch, the input impedance can be easily controlled since it behaves like a matching circuit. The additional inductance also helps to reduce the dimensions of the patch. If we consider a patch fed by a microstrip line, a short to ground at the contact point between the microstrip line and the patch introduces the desired inductance as shown in the equivalent circuit diagram of FIG. 2. This circuit is resonant at two frequencies. By adjusting the inductance and capacitance characteristics of the patch, the resonant frequencies can be adjusted so that the antenna has a relatively wide operating bandwidth-two to three times that of a singly resonant patch.

Figure 3:
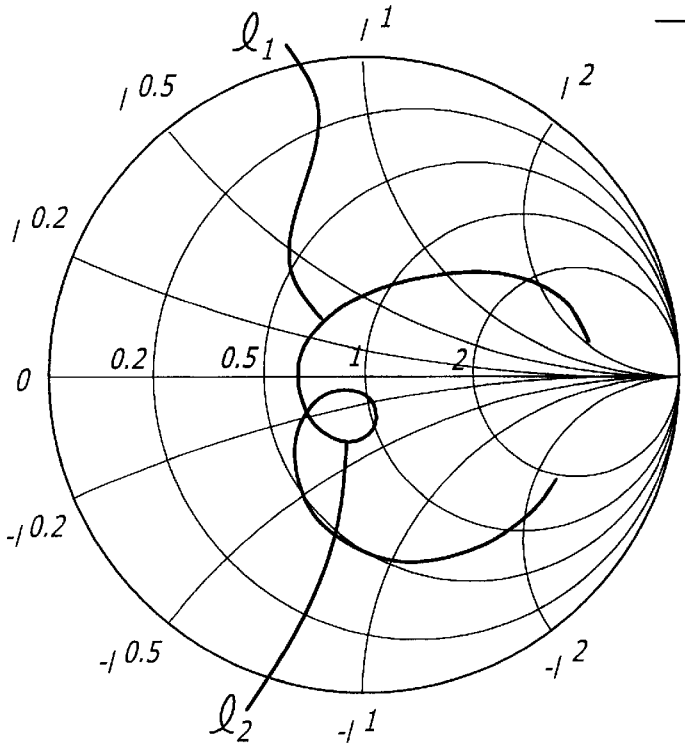
FIG. 3 is a Smith chart for an antenna having an equivalent circuit diagram as shown in FIG. 2.

Referring to FIG. 3, the double resonance of the shorted patch appears on a Smith chart as a large loop $l_1$ with a smaller loop $l_2$ that comes closer to the point of matched impedance (typically, but not necessarily, 50 ohms). Without the short, the antenna behaves just like an open circuit.

Even with the double resonance achieved with the antenna design of the present invention, the bandwidth may not be large enough for some applications. The bandwidth can be further increased by increasing the thickness of the dielectric substrate. The bandwidth of the antenna is directly proportional to the thickness of the substrate.

Figure 4:
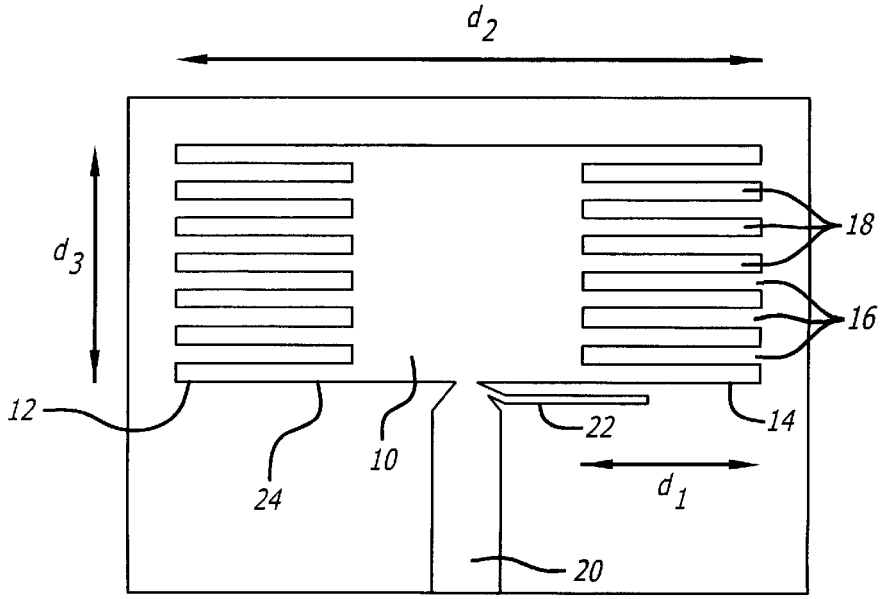
FIG. 4 is a plan view of a multi-finger patch antenna in accordance with the present invention.

One method of controlling the inductance and capacitance of the patch is illustrated in FIG. 4. A plurality of slots 16 are cut into opposing edges 12 and 14 of patch 10. The slots 16 define a corresponding plurality of fingers 18. The widths of slot 16 and fingers 18 are shown as being approximately equal, but this need not be the case. FIG. 4 also shows strip line feed 20 and shunt 22. Although feed 20 is illustrated as a microstrip line, patch 10 may also be feed with a coaxial cable from above, from underneath, or from the edge. Feed 20 need not be centered along edge 24 as shown. The placement of the feed gives another degree of freedom for packaging considerations.

The characteristics of patch 10 may be tuned by adjusting the depth of slots 16 (dimension $d_1$), the overall length of the patch (dimension $d_2$) and the overall width of the patch (dimension $d_3$). It should be noted that $d_1$, $d_2$ and $d_3$ need not be uniform across the entire patch. The shape of the patch can be adjusted to fit within packaging constraints. As explained above, shunt 22 is very important for the resonance characteristics of patch 10, but it does not have a particularly large influence on impedance matching. Shunt 22 may be used to fine-tune the input impedance of patch 10.

Patch 10 is preferably formed of copper cladding using conventional printed circuit techniques on a dielectric substrate. A ground plane of copper cladding is disposed on the surface of the substrate opposite patch 10. It is desirable for the substrate to have a relatively high dielectric coefficient as this allows the physical dimensions of patch 10 to be made smaller. Suitable materials for the substrate are TMM 6 or TMM 10 available from the Microwave Materials Division of Rogers Corporation, Chandler, Ariz. These materials are thermoset ceramic loaded plastics having dielectric coefficients of approximately 6 and 9.2, respectively. Equivalent materials from other vendors may also be utilized.

The effect of dimensions $d_1$, $d_2$ and $d_3$ on the characteristics of patch 10 may be better understood with reference to the Smith chart shown in FIG. 3. The effect of changing $d_1$, is to rotate the position of the small loop $l_2$ relative to $l_1$ on the Smith chart without changing the position of the frequencies relative to the loop. Increasing $d_1$ causes $\mathbf{1}_2$ to move clockwise. The effect of $d_3$ is exactly the opposite of $d_1$, i.e., decreasing $d_3$ causes $l_2$ to move counterclockwise on the Smith chart, again without affecting the position of the frequencies relative to the loop. The effect of changing $d_2$ is to rotate the $l_2$ loop, but with the frequencies rotating in the opposite direction. Reducing $d_2$ causes the $l_2$ loop to move clockwise, whereas the frequencies rotate counterclockwise. The distance between shunt 22 and edge 24 controls the diameter of the small loop $1_2$. The closer the shunt is, the larger the diameter of $1_2$ is. The dimensions of the ground plane underlying patch 10 also has a large influence on the diameter of the $l_2$ loop. The smaller the ground plane is, the larger the diameter of the $l_2$ loop is. In the case of a small ground plane, the increased diameter of the $l_2$ loop can be compensated for by increasing the distance between the shunt and the patch.

The number of slots 16 and fingers 18 does not have a significant effect on impedance matching. As explained above, increasing the length of the slots 16 has the opposite effect of reducing the overall width of the patch. Therefore, impedance matching of the antenna is influenced more by the overall width of the antenna rather than by the number of slots and fingers. However, by reducing the width of the slots and the width of the fingers (as mentioned above, the widths of the slots and fingers need not be equal), it is possible to have better control over the minimum possible width of the antenna. Moreover, due to the current distribution on the antenna, the more fingers the antenna has, the more resonances can be gathered in the same frequency range and the wider the working bandwidth can be.

Figure 5:
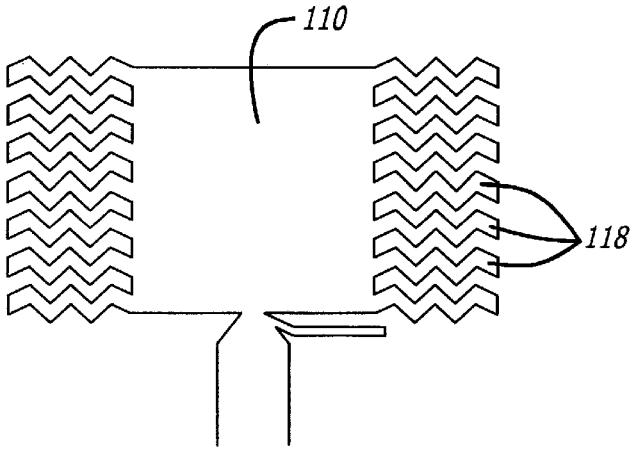
FIG. 5 is a plan view of an alternative embodiment of the present invention.

In order to reduce the physical dimensions of the patch, the dielectric coefficient of the substrate may be increased. The overall dimensions of the patch are inversely proportional to the square root of the dielectric coefficient. However, suitable materials with high dielectric coefficients add significantly to the cost. An alternative approach is illustrated in FIG. 5. Here, the fingers 118 of patch 110 have a zigzag configuration so that, for a given effective width of the fingers, the overall width of the patch may be reduced.

Figure 6:
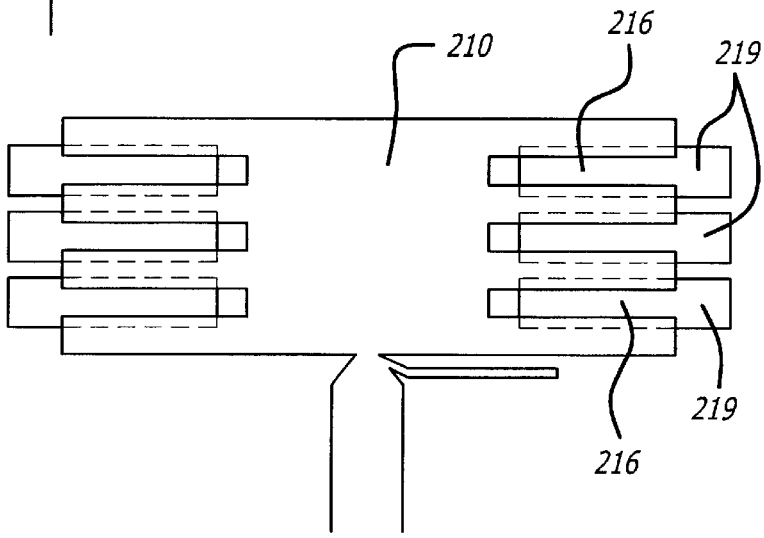
FIG. 6 is a plan view of another alternative embodiment of the present invention.
Figure 7:
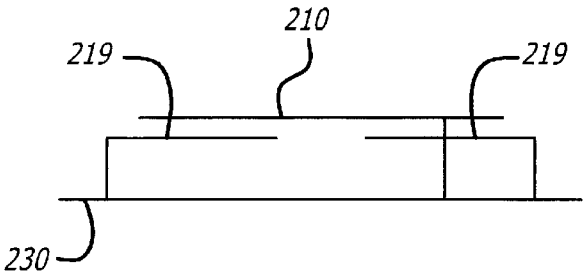
FIG. 7 is a cross-sectional view of the embodiment of FIG. 6.

The simplest way to further reduce the dimensions of the patch is to increase the capacitance. This can be done directly by adding one or more additional conductive layers as illustrated in FIGS. 6 and 7. Here, a plurality of islands 219 are formed in an additional conductive layer below patch 210. Each of the islands 219 is positioned below a corresponding slot 216 and is coupled to the ground plane 230. Alternatively, or in addition, the islands could be above the slots.

Figure 8:
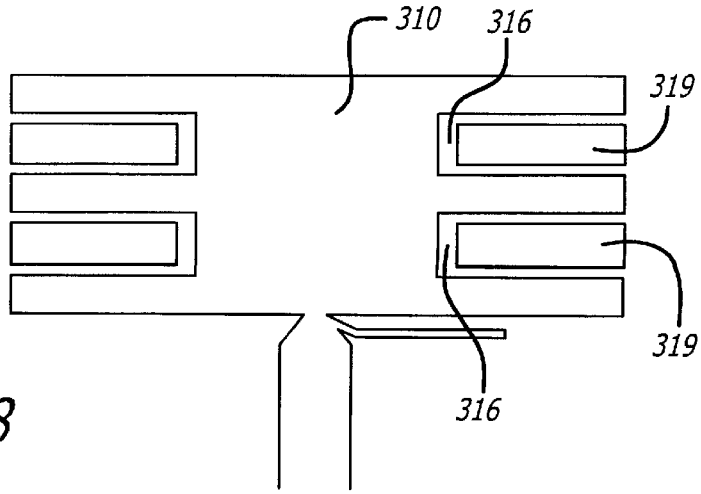
FIG. 8 is a plan view of another alternative embodiment of the present invention.

Another approach for increasing the capacitance is shown in FIG. 8. Here, parasitic islands 319 are formed within slots 316 in the same layer of conductive material as patch 310. Again, each of islands 319 is coupled to the underlying ground plane.

Figure 9:
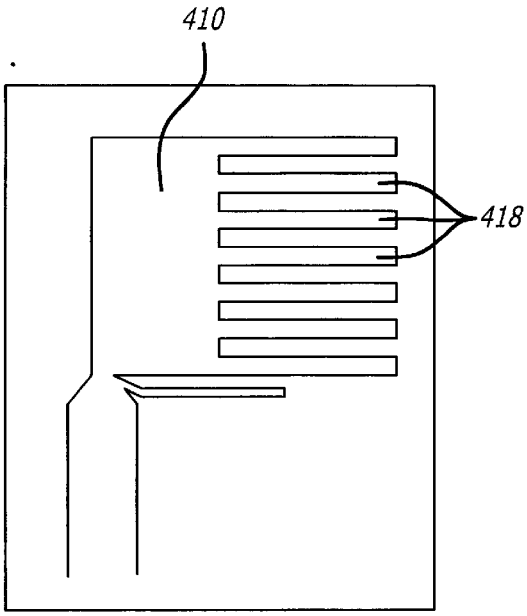
FIG. 9 is a plan view of a "half" multi-finger patch according to the present invention.

A straightforward approach for reducing the dimensions of the antenna is illustrated in FIG. 9. Patch 410 has only a single array of fingers 418. Although the current distribution with patch 410 is not the same as in patch 10, the optimization is very similar. In this nonsymmetrical configuration, there are two or more separated frequencies with radiating modes (more widely separated than in a symmetrical configuration), and non-radiating mode(s) in between.

Figure 10:
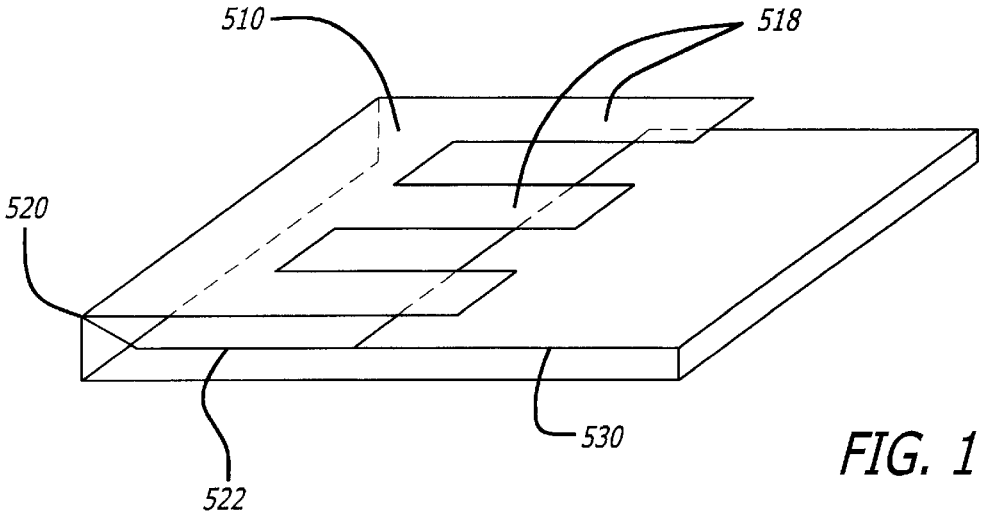
FIG. 10 is a perspective view of another alternative embodiment of the present invention.

Another design employing a "half" multi-finger patch is illustrated in FIG. 10. Antenna 510 comprises a folded conductor without a separate ground plane. A dielectric substrate is not utilized in this design. Shunt 522 extends from the feed point 520 to a floating ground 530 underlying fingers 518.

Figure 11:
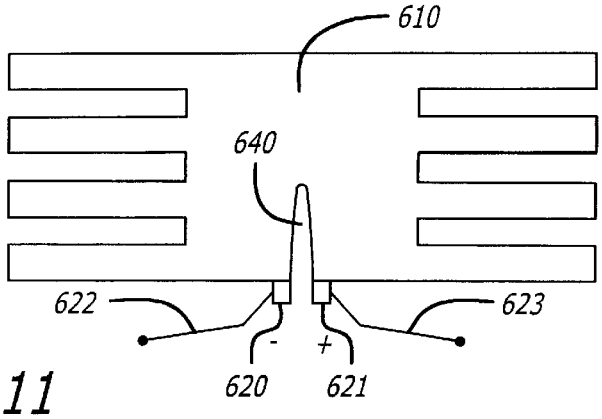
FIG. 11 is a plan view of still another alternative embodiment of the present invention.

FIG. 11 illustrates a patch 610 with a balanced input. Separate feeds 620 and 621 are provided on each side of the antenna with respective shunts 622 and 623. A slot 640 between the two feeds permits the inputs to be matched so that currents within the patch from the respective feeds are in phase.

Figure 12:
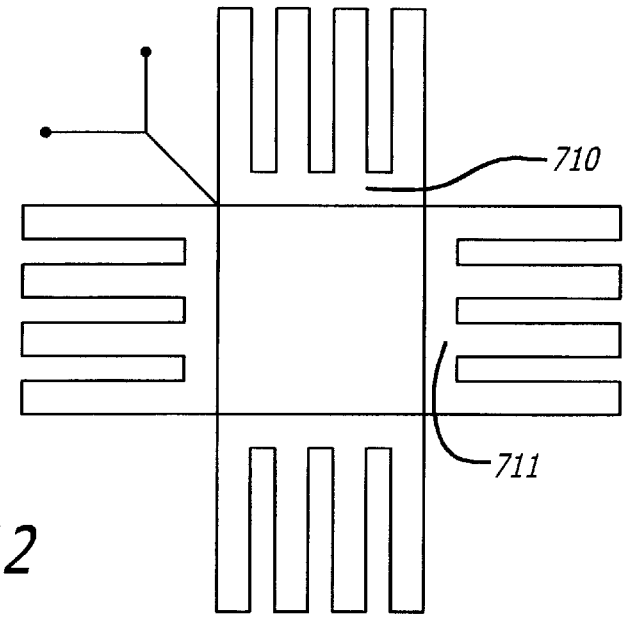
FIG. 12 is a plan view of yet another alternative embodiment of the present invention.

In order to counteract fading in wireless communications systems, it is desirable to have diversity of antenna characteristics. Once such diversity, for example, is polarization diversity. Polarization diversity can be easily obtained with the finger patch antenna of the present invention by overlapping two patches in orthogonal directions as shown in FIG. 12. Patches 710 and 711 are each constructed as discussed previously in connection with FIG. 4. It will be appreciated that these patches can be constructed using any of the various alternative embodiments discussed herein.

Figure 13:
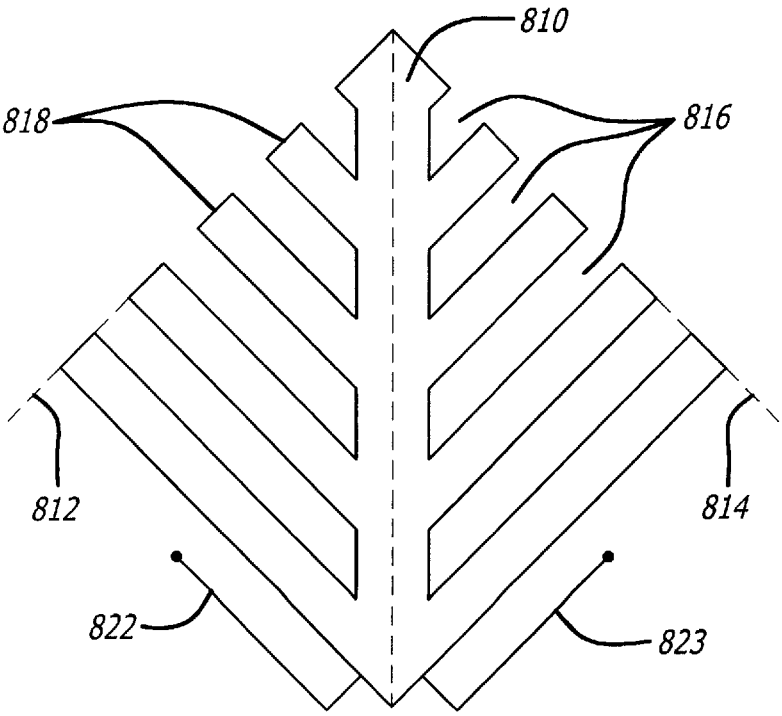
FIG. 13 is a plan view of a further embodiment of the present invention.

Another embodiment of the present invention is illustrated in FIG. 13. Slots 816 are cut into adjoining edges 812 and 814 of patch 810. Shunts 822 and 823 are provided for each half array of fingers 818.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. An antenna comprising:

a dielectric substrate having opposing first and second surfaces;

a radiating patch on the first surface of the substrate, said radiating patch having a plurality of edges and a plurality of spaced slots opening along one of the edges;

a ground plane on the second surface of the substrate;

a feed connected to the radiating patch; and a shunt connected at a first end thereof to the radiating patch adjacent to the feed and connected at a second end thereof to the ground plane.

2. The antenna of claim 1 wherein the radiating patch is rectangular.

3. The antenna of claim 2 wherein the radiating patch includes a first plurality of slots opening along a first edge and a second plurality of slots opening along a second edge opposite the first edge.

4. The antenna of claim 3 wherein the feed is connected to the radiating patch adjacent to a third edge disposed between the first and second edges.

5. The antenna of claim 4 wherein the feed is connected to the radiating patch approximately equidistant from the first and second edges.

6. The antenna of claim 4 wherein the shunt is routed along the first surface of the substrate, parallel to the third edge of radiating patch.

7. The antenna of claim 3 wherein the slots have a zigzag shape.

8. The antenna of claim 3 wherein the feed is a first feed connected to the radiating patch adjacent to a third edge disposed between the first and second edges and wherein the shunt is a first shunt connected adjacent to the first feed and routed along the first surface of the substrate toward the first edge, parallel to the third edge of the radiating patch.

9. The antenna of claim 8 further comprising a second feed on the third edge and a second shunt connected at a first end thereof to the radiating patch adjacent to the second feed and connected at a second end thereof to the ground plane, wherein the second shunt is routed along the first surface of the substrate toward the second edge, parallel to the third edge of the radiating patch.

10. The antenna of claim 9 further comprising a slot opening along the third edge and disposed between the first and second feeds.

11. The antenna of claim 2 wherein the radiating patch includes a first plurality of slots opening along a first edge and a second plurality of slots opening along a second edge adjacent to the first edge.

12. The antenna of claim 11 wherein the feed is connected to the radiating patch adjacent to an intersection of a third edge opposite the first edge and a fourth edge opposite the second edge.

13. The antenna of claim 12 wherein the shunt is a first shunt routed along the first surface of the substrate, parallel to the third edge of the radiating patch.

14. The antenna of claim 13 further comprising a second shunt connected at a first end thereof to the radiating patch adjacent to the feed and connected at a second end thereof to the ground plane, wherein the second shunt is routed along the first surface of the substrate, parallel to the fourth edge of the radiating patch.

15. The antenna of claim 1 wherein the feed comprises a strip line.

16. The antenna of claim 1 wherein the feed comprises a coaxial cable.

17. The antenna of claim 1 wherein the slots have a zigzag shape.

18. The antenna of claim 1 further comprising a plurality of parasitic grounded islands co-planar with the patch, each of the islands disposed within a respective one of the plurality of slots.

19. The antenna of claim 1 further comprising a plurality of parasitic grounded islands disposed in a plane parallel to and separated from the patch.

20. The antenna of claim 19 wherein the plurality of islands are disposed in an array corresponding to the plurality of slots.

21. The antenna of claim 1 wherein the plurality of slots are disposed perpendicular to said one of the edges.

22. An antenna comprising:

a dielectric substrate having opposing first and second surfaces;

a generally rectangular radiating patch on the first surface of the substrate having first and second pluralities of spaced slots opening along opposing first and second edges, respectively, of the radiating patch;

a ground plane on the second surface of the substrate;

a feed connected to the radiating patch; and a shunt connected at a first end thereof to the radiating patch adjacent to the feed and connected at a second end thereof to the ground plane.

23. The antenna of claim 22 wherein the shunt is routed along the first surface of the substrate.

24. The antenna of claim 23 wherein the feed is connected to a third edge of the radiating patch and the shunt is routed parallel to the third edge.

25. The antenna of claim 23 wherein the slots have a zigzag shape.

26. The antenna of claim 23 further comprising a plurality of parasitic grounded islands co-planar with the patch, each of the islands disposed within a respective one of the plurality of slots.

27. The antenna of claim 23 further comprising a plurality of parasitic grounded islands disposed in a plane parallel to and separated from the patch.

28. The antenna of claim 27 wherein the plurality of islands are disposed in an array corresponding to the plurality of slots.

29. The antenna of claim 22 wherein the first plurality of slots are disposed perpendicular to the first edge and the second plurality of slots are disposed perpendicular to the second edge.

30. An antenna comprising:

a dielectric substrate having opposing first and second surfaces;

a generally rectangular radiating patch on the first surface of the substrate having first and second pluralities of spaced slots opening along adjacent first and second edges, respectively, of the radiating patch;

a ground plane on the second surface of the substrate;

a feed connected to the radiating patch; and a shunt connected at a first end thereof to the radiating patch adjacent to the feed and connected at a second end thereof to the ground plane.

31. The antenna of claim 30 wherein the shunt is routed along the first surface of the substrate.

32. The antenna of claim 31 wherein the shunt is routed parallel to a third edge of the radiating patch.

33. The antenna of claim 30 wherein the first plurality of slots are disposed perpendicular to the first edge and the second plurality of slots are disposed perpendicular to the second edge.

* * * * *